United States Patent [19]

Markwardt

[11] Patent Number: 4,817,282

[45] Date of Patent: Apr. 4, 1989

[54] CABLE SPLICING METHOD WHILE MAINTAINING ELECTRICAL CONNECTION

[75] Inventor: Terrance L. Markwardt, Cedar Park, Tex.

[73] Assignee: Minnesota Mining and Manufacturing Company, St. Paul, Minn.

[21] Appl. No.: 152,456

[22] Filed: Feb. 5, 1988

[30] Foreign Application Priority Data

Feb. 20, 1987 [JP] Japan ..... 62-37721

[51] Int. Cl.[4] ..... H01R 43/00

[52] U.S. Cl. ..... 29/868; 29/869; 439/477

[58] Field of Search ..... 29/868, 869, 872, 871, 29/854, 866; 439/477, 478, 480, 514, 515, 712

[56] References Cited

U.S. PATENT DOCUMENTS

| | | | |
|---|---|---|---|
| 1,011,600 | 12/1911 | Forrest | 439/477 |
| 2,668,201 | 2/1954 | Welsh | 439/477 X |
| 2,874,364 | 2/1959 | Graham | 439/477 |
| 4,162,815 | 7/1979 | Fleischhacker | 439/502 X |
| 4,400,047 | 8/1983 | Simms | 439/712 X |
| 4,464,834 | 8/1984 | Simms | 29/854 |
| 4,496,206 | 1/1985 | Markwardt et al. | |

*Primary Examiner*—Carl J. Arbes

*Attorney, Agent, or Firm*—Donald M. Sell; John C. Barnes

[57] ABSTRACT

A method of replacing a portion of an old telephone cable by a new cable portion without interrupting service to the line is handled by forming parallel circuits, redundant circuits and then disconnecting the old cable.

2 Claims, 3 Drawing Sheets

CABLE SPLICING METHOD WHILE MAINTAINING ELECTRICAL CONNECTION

BACKGROUND OF THE INVENTION

1. Field of the Invention

The present invention relates to a cable splicing method while maintaining electrical connection and not interrupting service, and more particularly to a method of replacing a portion of an old cable by a new cable through making use of side entry electrical wire connectors, piercing probes and a piece of transfer equipment.

2. Description of the Prior Art

Heretofore, in replacing a portion of a cable being used by a new cable, the old cable has been transferred to the new cable by cutting the former to temporarily interrupt the electrical connection.

When an old cable, particularly a telephone cable, is cut to be replaced by a new cable, the electrical connection being used is interrupted at the time of cutting and it becomes disabled until the completion of the replacing operation.

SUMMARY OF THE INVENTION

According to the present invention, there is provided a method of replacing a portion of an old cable by a new cable through making use of side entry electrical wire connectors, piercing probes and a piece of transfer equipment. The old and new cables, respectively, contain therein a plurality of wire pairs. The method of the present invention comprises the steps of partly removing an outer sheath of the old cable to expose the plurality of wire pairs; attaching first and second piercing probes to a wire pair of the old cable being removed and attaching a third piercing probe to a corresponding wire pair of the new cable. The three piercing probes, each connected to the wire pairs are connected to a piece of transfer equipment. By closing bridging relays or their equivalent in the transfer equipment between the two piercing probes attached to the old cable pair a parallel circuit is established between the two piercing probes. Cutting the old cable wire pair between the two piercing probes will break the parallel circuit, transferring the electrical connection between the first and second piercing probes attached to the old cable wire pair to the second piercing probe attached to the old cable and the third piercing probe attached to the new cable wire pair. Then by using the side entry electrical wire connectors, connect the new cable wire pair to the old cable wire pair to which one of the two piercing probes is attached. Remove the piercing probe from the old and new cable wires. By repeating the above steps for subsequent old and new cable wire pairs the entire new cable is substituted, the portion of the old cable is replaced.

DETAILED DESCRIPTION OF THE PREFERRED EMBODIMENT

Figure 1:
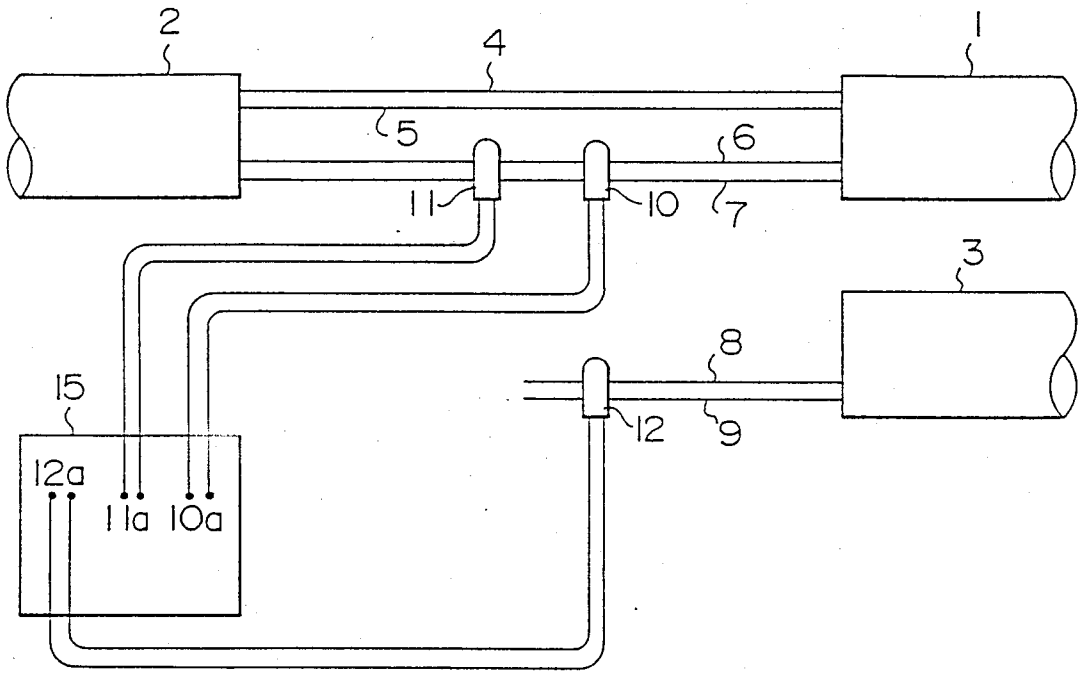
FIG. 1 is an illustration showing the state in which the intermediate part of an old cable and the end of a new cable are stripped, off to expose their wire pairs and piercing probes are attached to the respective wire pairs.

Referring to FIG. 1, outer sheaths of an old cable portion 1 being transferred and an old cable portion 2 to be left are removed over a predetermined length therebetween to expose wire pairs, for example wires 4, 5, and wires 6, 7. The old cable portions 1, 2 are currently being used and electrical connection is maintained in the respective wire pairs 4, 5; 6, 7. A new cable portion 3 is placed adjacent the old cable portion 1 with its outer sheath removed from the end over a predetermined length to expose a wire pair 8, 9. While each of these cable portions 1, 2 and 3 contains a number of wire pairs, only the three wire pairs are shown for simplicity. A piece of transfer equipment 15 has terminals 10*a*, 11*a*, and 12*a* to which are connected piercing probes 10, 11, and 12, respectively, the former two 10, 11 being attached to one wire pair 6, 7 of the old cable portion and the last one 12 being attached to the corresponding wire pair 8, 9 of the new cable portion. The piercing probes 10, 11 and 12 may each have one pair of terminals provided with a number of dense sharp-pointed pins, for example, as described in the Japanese Utility Model Laid-Open No. 60-96786. In the connected state shown in FIG. 1, bridging relays (not shown) between the terminals 11*a* and 10*a* of the transfer equipment are closed so that the electrical connection through the old cable wire pair 6, 7 is established by the wire pair 6, 7 itself as well as a parallel circuit consisting of the piercing probe 11, the terminals 11*a*, 10*a* of the transfer equipment 15, and the piercing probe 10.

Figure 2:
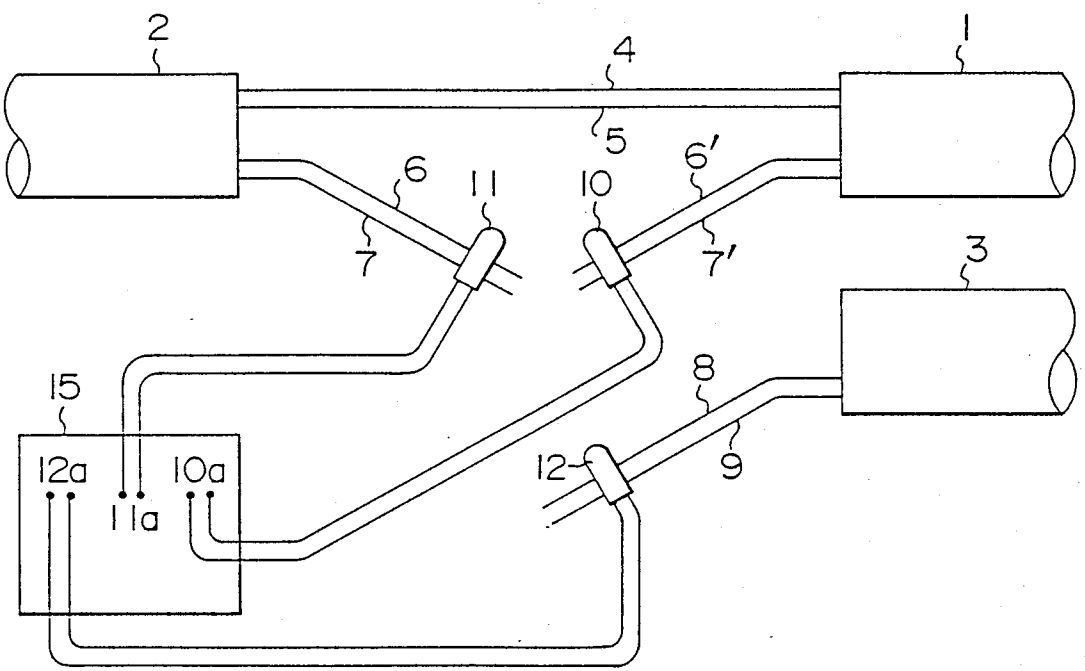
FIG. 2 is an illustration showing the state in which electrical connection is established from the wire pair of the old cable to the wire pair of the new cable and the wire pair of the old cable is cut.
Figure 3:
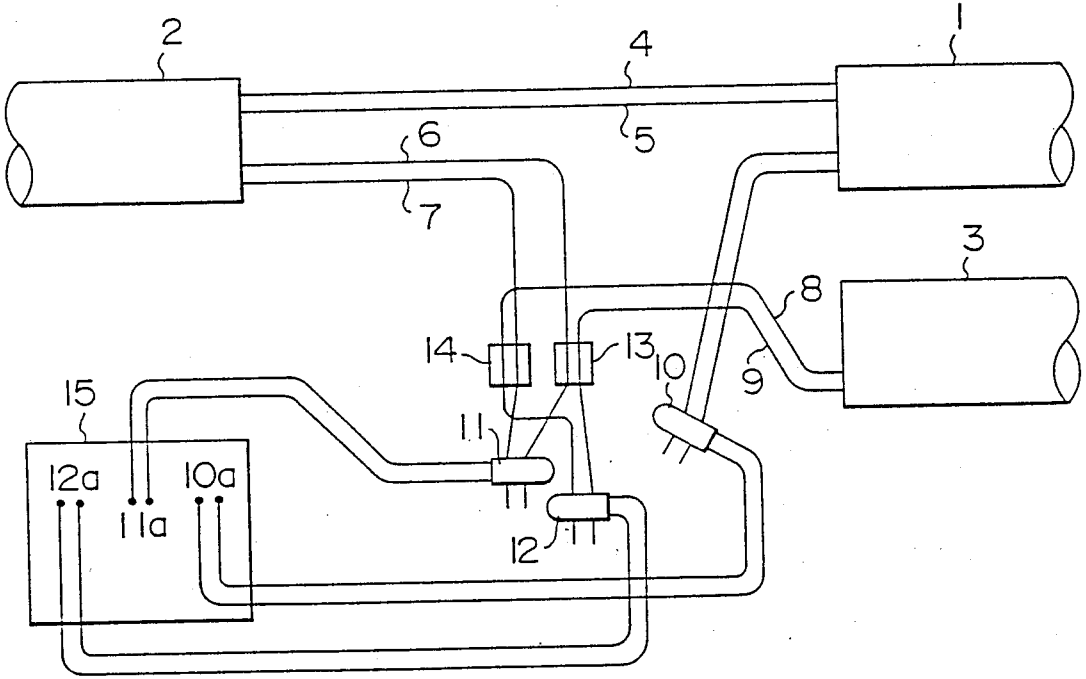
FIG. 3 is an illustration showing the state in which side entry electrical wire connectors are attached to the wire pairs of the respective cables.

Then, the old cable wire pair 6, 7 are cut by means of a manual tool between the piercing probes 11 and 10 (see FIG. 2). In this state, the electrical connection established by the wire pair 6, 7 itself of the old cables 1, 2 is interrupted, while the electrical connection from the wire pair 6, 7 of the old cable 2 to a wire pair 6', 7' of the old cable 1 still remains maintained through the abovementioned parallel circuit. Also in this state, bridging relays between the terminals 11*a* and 12*a* of the transfer equipment 15 are closed. Then, the bridging relays between the terminals 11*a* and 10*a* are opened. Thus, the electrical connection from the wire pair 6, 7 of the old cable 2 to the wire pair 8, 9 of the new cable 3 is established through the piercing probe 11, the terminals 11*a*, 12*a* of the transfer equipment 15, and the piercing probe 12, while the electrical connection from the wire pair 6, 7 of the old cable 2 to the wire pair 6', 7' of the old cable 1 is interrupted. Next, by making use of two side entry electrical wire connectors 13, 14 as described in the U.S. Pat. No. 4,496,206, for example, the wire pair 6, 7 of the old cable 2 is connected to the wire pair 8, 9 of the new cable 3 as shown in FIG. 3. When the connectors 13, 14 are clamped completely, the electrical connection is established from the wire pair 6, 7 to the wire pair 8, 9. The extra wires between the connectors and the probes can be cut off for removal from the connectors. After that, the three piercing probes 10, 11, and 12 are released from the respective wire pairs and then attached to the next wire pair 4, 5 of the old cables 1, 2 as well as a corresponding wire pair of the new cable 3 (not shown). In this manner, the wire pairs of the old cable 1 are replaced by corresponding wire pairs of the new cable 3, one after the other.

After replacing all the wire pairs of the old cable 1 by corresponding wire pairs of the new cable 3, the connectors and the wire pairs exposed between the cables 2 and 3 are bundled together for the completion of splicing.

An example of a transfer unit is the equipment sold by Minnesota Mining and Manufacturing Company (3M), Austin, Tex. and identified as the MACS 3000.

I claim:

1. A method of replacing a portion of an old cable by a new cable by making use of side entry electrical wire connectors, piercing probes and a transfer equipment, which old and new cables, respectively, contain therein a plurality of wire pairs, said method comprising the steps of:

partly removing an outer sheath of the old cable to expose the plurality of wire pairs;

attaching first and second piercing probes to a wire pair of the old cable being transferred and attaching a third piercing probe to a corresponding wire pair of the new cable;

closing bridging relays of the transfer equipment between the two piercing probes attached to the old cable pair to establish a parallel circuit between the two piercing probes;

cutting the old cable wire pair between the two piercing probes to break the parallel circuit;

transferring the electrical circuit between the first and second piercing probes attached to the old cable wire pair to the second piercing probe attached to the old cable and the third piercing probe attached to the new cable wire pair;

using the side entry electrical wire connectors to connect the new cable wire pair to the old cable wire pair to which said one of the two piercing probes is attached;

removing said piercing probes from the old and new cable wires; and repeating the above steps for subsequent old and new cable wire pairs.

2. A method as recited in claim 1, wherein the side entry connector has wire cut-off means and connects a new cable wire to an old cable wire and then cuts off the ends of the wires attached between the connectors and the piercing probes.

* * * * *